US007722725B2

(12) United States Patent
Park et al.

(10) Patent No.: US 7,722,725 B2
(45) Date of Patent: May 25, 2010

(54) DISHWASHER AND SUMP ASSEMBLY THEREOF

(75) Inventors: Nung Seo Park, Incheon (KR); Sang Heon Yoon, Seoul (KR); Byung Hwan Ahn, Changwon-si (KR); Dae Yeong Han, Seoul (KR)

(73) Assignee: LG Electronics, Inc., Seoul (KR)

( * ) Notice: Subject to any disclaimer, the term of this patent is extended or adjusted under 35 U.S.C. 154(b) by 1012 days.

(21) Appl. No.: 11/058,418

(22) Filed: Feb. 16, 2005

(65) Prior Publication Data

US 2006/0060222 A1 Mar. 23, 2006

(30) Foreign Application Priority Data

Sep. 22, 2004 (KR) ..... 10-2004-0075929

(51) Int. Cl.
*B08B 3/04* (2006.01)

(52) U.S. Cl. ..... 134/56 D; 134/57 D; 134/58 D; 134/104.2

(58) Field of Classification Search ..... 134/56 D, 134/57 D, 58 D, 104.2
See application file for complete search history.

(56) References Cited

U.S. PATENT DOCUMENTS

| | | | | |
|---|---|---|---|---|
| 4,150,680 | A | 4/1979 | Johnson et al. | |
| 4,243,431 | A | 1/1981 | Dingler et al. | |
| 4,392,891 | A * | 7/1983 | Meyers | 134/10 |
| 4,448,359 | A | 5/1984 | Meyers | |
| 5,377,707 | A | 1/1995 | Young, Jr. | |
| 5,433,232 | A | 7/1995 | Young, Jr. | |
| 5,450,868 | A * | 9/1995 | Young, Jr. | 134/111 |
| 5,601,660 | A * | 2/1997 | Jeon et al. | 134/10 |
| 5,609,172 | A | 3/1997 | Chang et al. | |
| 5,779,812 | A | 7/1998 | Thies et al. | |
| 5,909,743 | A | 6/1999 | Thies et al. | |
| 6,182,674 | B1 | 2/2001 | Jozwiak et al. | |
| 6,418,943 | B1 | 7/2002 | Miller | |
| RE37,831 | E | 9/2002 | Thies | |
| 7,409,962 | B2 | 8/2008 | Welch | |
| 2003/0205246 | A1 | 11/2003 | Christman et al. | |
| 2004/0103926 | A1 | 6/2004 | Ha | |
| 2005/0263174 | A1 | 12/2005 | Yoon et al. | |

FOREIGN PATENT DOCUMENTS

| | | |
|---|---|---|
| DE | 2951837 A1 | 7/1980 |
| DE | 4418523 A1 | 11/1995 |
| GB | 901 476 | 7/1962 |

(Continued)

OTHER PUBLICATIONS

STIC Human Translation—Cho, Young-Man (KR 1998-057987 U).*

*Primary Examiner*—Michael Cleveland
*Assistant Examiner*—Samuel A Waldbaum
(74) *Attorney, Agent, or Firm*—McKenna Long & Aldridge LLP

(57) ABSTRACT

The present invention provides a sump assembly of a dishwasher, by which water can be purified. The present invention includes a sump housing storing water therein, a pump coupled with the sump housing to pump the water, a guide assembly provided within the sump housing to guide the pumped water to a sprayer, and a drain chamber configured to filter contaminant from the water drained from the guide assembly.

36 Claims, 4 Drawing Sheets

FOREIGN PATENT DOCUMENTS

| | | | |
|---|---|---|---|
| GB | 2 038 171 | A | 7/1980 |
| GB | 230871 | | 7/1980 |
| GB | 2 204 482 | | 11/1988 |
| KR | 20-1998-0057987 | | 10/1998 |
| KR | 1998-057987 | U * | 10/1998 |
| KR | 20-2000-0003391 | | 2/2000 |
| KR | 10-339370 | | 6/2000 |
| KR | 10-2001-0077128 | | 8/2001 |
| SU | 1738259 | A1 | 6/1992 |

* cited by examiner

DISHWASHER AND SUMP ASSEMBLY THEREOF

This application claims the benefit of the Korean Application No. P2004-75929 filed on Sep. 22, 2004, which is hereby incorporated by reference.

BACKGROUND OF THE INVENTION

1. Field of the Invention

The present invention relates to a dishwasher, and more particularly, to a sump assembly of a dishwasher.

2. Discussion of the Related Art

Generally, a dishwasher is a home appliance for washing dishes or tableware automatically by spraying water of high pressure on the tableware using spray nozzles. A dishwasher basically consists of at least one rack provided within a tub to have dishes put thereon, a sump storing water therein, and at least one sprayer for spraying the water on the dishes.

In the general dishwasher, the water is pumped from the sump to the sprayer and the pumped water is sprayed toward the dishes for washing. The sprayed water is collected into the sump to be re-supplied to the sprayer so that the re-supplied water can be sprayed on the dishes.

However, as the water is repeatedly used, a quantity of contaminant involved in the water gradually increases to lower washing performance of the dishwasher. Specifically, it is highly probable that a passage within the sump is blocked by the contaminant.

SUMMARY OF THE INVENTION

Accordingly, the present invention is directed to a sump assembly of a dishwasher that substantially obviates one or more problems due to limitations and disadvantages of the related art.

An object of the present invention is to provide a sump assembly of a dishwasher, by which contaminant or garbage can be removed from water.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a sump assembly of a dishwasher according to the present invention includes a sump housing storing water therein, a pump coupled with the sump housing to pump the water, a guide assembly provided within the sump housing to guide the pumped water to a sprayer, and a drain chamber configured to filter contaminant from the water drained from the guide assembly.

Preferably, the drain chamber is configured to deposit the contaminant on a bottom of the drain chamber. And, the contaminant has a relatively heavy weight. For such a filtering function, the drain chamber always communicates with the guide assembly and the guide assembly communicates with the guide assembly only while dishes are washed. And, the water returns to the guide assembly via the drain chamber. Moreover, the drain chamber is provided within the sump housing. Specifically, the drain chamber is situated below the guide assembly. Namely, the drain chamber is configured to allow the water to flow downwardly to the drain chamber from the guide assembly. And, the drain chamber is configured to allow the water to flow upwardly from the drain chamber to the guide assembly.

Preferably, the drain chamber is configured to externally drain the water within the sump assembly. In this case, the drain chamber externally discharges the water within the sump housing and the guide assembly. And, the drain chamber is connected to a drain pump configured to drain the water from the drain chamber. Moreover, the drain chamber additionally communicates with the sump housing if the water is discharged from the dishwasher.

Preferably, the sump assembly further includes a valve configured to allow the drain chamber to communicate with the sump housing selectively. The valve allows the drain chamber to communicate with the sump housing while the water is drained from the dishwasher. The valve isolates the drain chamber from the sump housing while dishes are washed. Specifically, the valve is provided to the drain chamber to open/close an opening communicating with the sump housing selectively. More preferably, the valve is a check valve. More preferably, the valve includes a valve body opening/closing an opening provided to the drain chamber and a fixing portion fixing the valve body to the drain chamber. And, the valve body comprises a protrusion tightly fitted in the opening.

Preferably, the guide assembly is configured to bypass a portion of the pumped water to the drain chamber. More preferably, the guide assembly further includes a soil chamber communicating with the drain chamber to additionally filter the contaminant from the water drained from the drain chamber.

Preferably, the sump assembly further includes a cover covering the sump housing and the guide assembly. And, the cover includes at least one aperture guiding the water sprayed on dishes to the sump housing.

In another aspect of the present invention, a dishwasher includes a housing, a tub provided within the housing to receive tableware therein, a sprayer provided within the tub to spray water on the tableware, and a sump assembly including a sump housing storing the water therein, a pump coupled with the sump housing to pump the water, a guide assembly provided within the sump housing to guide the pumped water to a sprayer, and a drain chamber configured to filter contaminant from the water drained from the guide assembly.

Therefore, the contaminant can be completely removed from the water. And, the washing efficiency is not lowered despite repeated use of the water.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
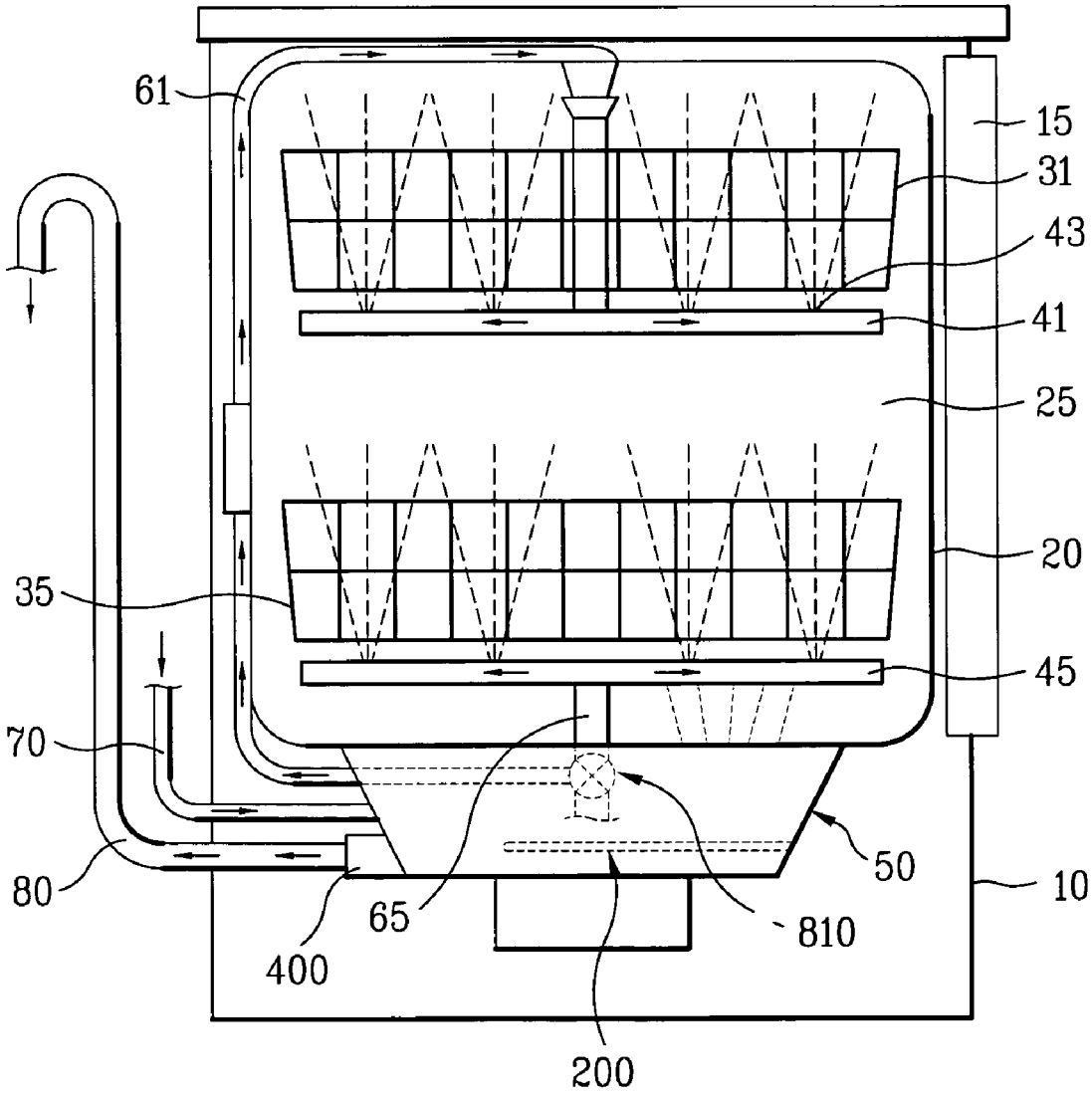
FIG. 1 is a cross-sectional diagram of a dishwasher according to the present invention.

FIG. 1 is a cross-sectional diagram of a dishwasher according to the present invention.

Referring to FIG. 1, a tub 20 is provided within a case 10 forming an exterior of a dishwasher, and a door 15 opening/closing the tub 20 is provided to one side of the case 10. A washing chamber 25 for accommodating tableware or dishes therein is provided within the tub 20. And, at least one rack is provided to the washing chamber 25 so that the dishes can be put thereon. For instance, the rack, as shown in FIG. 1, includes an upper rack 31 provided to an upper part of the washing chamber 25 and a lower rack 35 provided to a lower part of the washing chamber 25.

Moreover, at least one spray arm is provided in the vicinity of the rack within the washing chamber 25. For instance, the spray arm, as shown in FIG. 1, includes an upper arm 41 arranged under the upper rack 31 and a lower arm 45 arranged under the lower rack 35. The upper and lower arms 41 and 45 are respectively rotatable, and each of the upper and lower arms 41 and 45 includes at least one spray nozzle 43 spraying water toward the dishes.

A sump assembly 50 supplying water to the upper and lower arms 41 and 45 is provided within the case 10, e.g., under the tub 20. The sump assembly 50 is connected to the upper arm 41 via a first connecting pipe 61 and is connected to the lower arm 45 via a second connecting pipe 65. And, the sump assembly 50 is supplied with the water from outside via a water supply pipe 70 to store the supplied water therein and selectively or simultaneously supply the water to the upper and lower arms 41 and 45 via the first and second connecting pipes 61 and 65, respectively. A detailed configuration of the sump assembly 50 is shown in FIG. 2, and the sump assembly is explained in detail with reference to FIG. 2 as follows.

Figure 2:
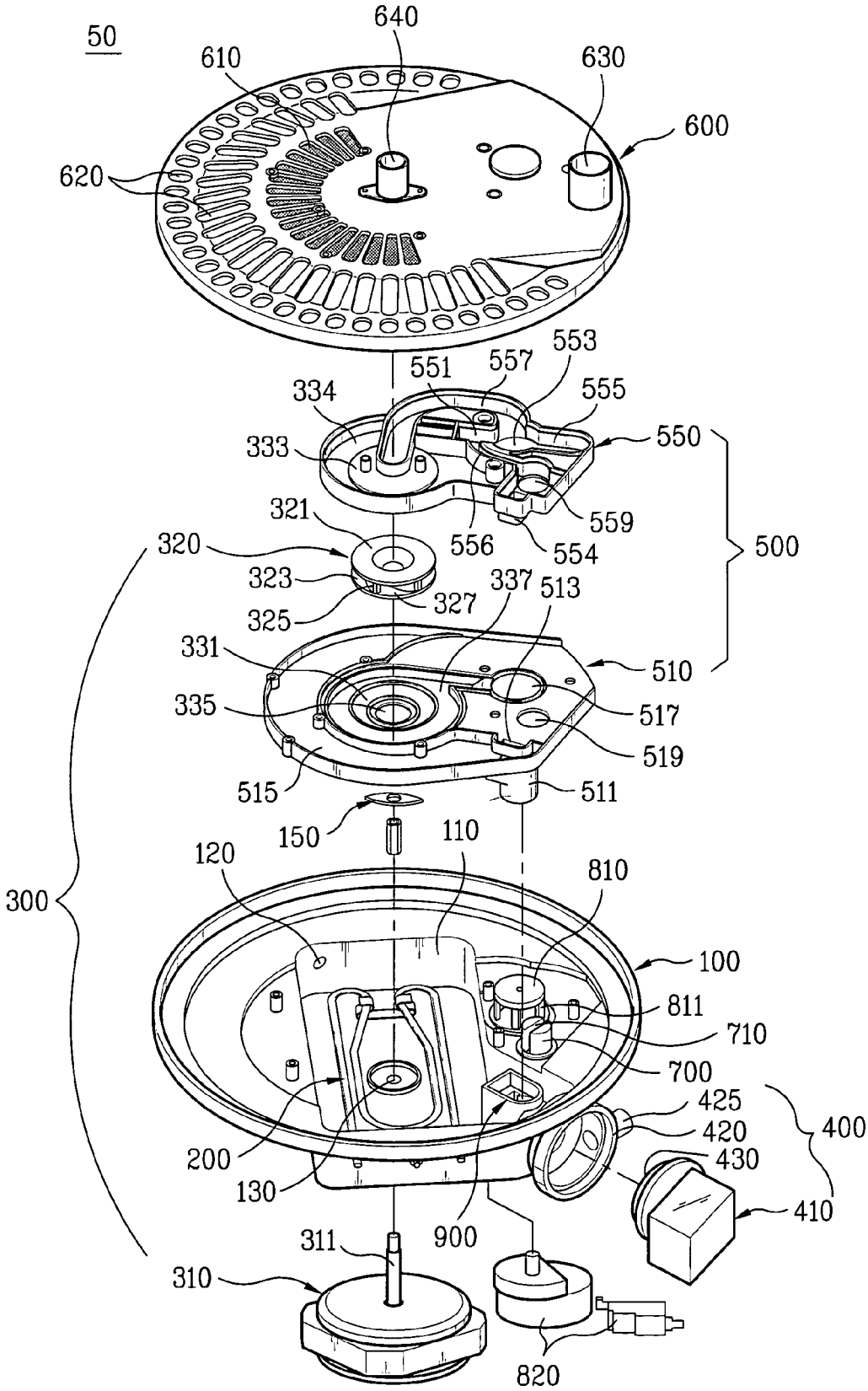
FIG. 2 is an exploded diagram of a sump assembly of a dishwasher according to the present invention.

Referring to FIG. 2, the sump assembly 50 includes a sump housing 100 storing water therein, a water supply pump 300 for pumping the water stored in the sump housing 100, and a water guide assembly 500 for guiding the pumped water to the upper and lower arms 41 and 45. And, the sump assembly 50 further includes a heater assembly 200 for heating the water, a drain pump 400 for draining the water outside, and a cover 600 covering the sump housing 100 to filter the water.

A recess 110 is provided to a bottom center of the sump housing 100 to store the water, and a water supply hole 120 is provided to one side of the recess 100 to be connected to the water supply pipe 70. And, a drain chamber 900 is provided to the sump housing 100 in the vicinity of the recess 110.

The drain pump 400 is loaded in a lateral side of the sump housing 100. The drain pump 400 communicates with the drain chamber 900 and discharges the water within the recess 110, the drain chamber 900, and the water guide assembly 500 outside. And, the drain pump 400 includes an impeller housing 420, a motor 410, and an impeller 430.

The impeller housing 420, as shown in FIG. 2, is coupled to a lateral side of the sump housing 100 and communicates with the drain chamber 900. The impeller housing 420 can be built in one body of the sump housing 100. A nipple 425 is projected from a lateral side of the impeller housing 420 to be connected to a drain hose 80.

The motor 410 having a shaft, with which the impeller 430 is coupled, is assembled to the impeller housing 420 so that the impeller 430 can be inserted in the impeller housing 420. Hence, once the drain pump 400 is actuated, the water stored in the recess 110 and the water guide assembly 500 is discharged outside via the drain chamber 900, the drain pump 400, and the drain hose 80.

The water supply pump 300 pumps the water over the heater assembly 200 to supply the water heated by the heater assembly 200 to the spray arms without heat loss. The water supply pump 300 includes a motor 310, an impeller 320, and an impeller housing, which is explained in detail as follows.

First of all, the motor 310, as shown in FIG. 2, is installed at a bottom of the sump housing 100. A shaft 311 of the motor 310 is installed to penetrate a hole 130 provided to a bottom of the recess 110. A disposer 150 having a multitude of blades, as shown in FIG. 2, is assembled to the shaft 311 penetrating the bottom of the sump housing 100. If the motor 310 is actuated, the disposer 150 is rotated to grind garbage that is contained in the water stored in the recess 110.

The impeller 320 is assembled to the shaft 311 as well. The impeller 320, as shown in FIG. 2, is situated over the heater assembly 200 and is rotated to pump the water. Specifically, the impeller 320 sucks the water in an axial direction and discharges the water in a radial direction. For this, the impeller 320 includes an upper plate 321, a lower plate 323 separated from the upper plate 321 to leave a predetermined gap from each other, and a multitude of blades 325 provided between the upper and lower plates 321 and 323. The upper plate 321 is blocked and an inlet (not shown in the drawing) is provided to a center of the lower plate 323 to have the water flow therein. A hub (not shown in the drawing) is provided to a center of the upper plate 321 and the shaft 311 is fitted in a lower end of the hub. A multitude of the curved blades 325 are provided between the upper and lower plates 321 and 323, and an outlet 327 is provided between the blades 325 to discharge the water having flown in the impeller 320 via the inlet.

The impeller housing encloses the impeller 320 to guide the water moved by the impeller 320. The impeller housing is preferably built in one body of the water guide assembly 500 instead of being formed of an independent body. In this case, the water guide assembly 500 includes a lower piece 510 and an upper piece 550. If the upper and lower pieces 550 are assembled together, a portion of the assembly configures the impeller housing. The impeller housing is explained in detail as follows.

First of all, to a top surface of the lower piece 510 of the water guide assembly 500, as shown in FIG. 2, provided are an inlet 335 via which the water stored in the recess 110 of the sump housing 100 flows, a lower recessed seat 331 accommodating a lower part of the impeller 320 therein, and a lower water passage 337 guiding the water pumped by the impeller 320. The lower recessed seat 331 is provided to enclose the inlet 335, and the inlet 335 communicates with the inlet (not shown in the drawing) of the impeller 320 situated on the lower recessed seat 331. And, the lower water passage 337 is provided to enclose the lower recessed seat 331.

To a bottom surface of the upper piece 550 of the water guide assembly 500 provided are an upper recessed seat 333 accommodating an upper part of the impeller 320 to confront the lower recessed seat 331, an upper water passage 334 guiding the water pumped by the impeller 320 to confront the lower water passage 337, and an outlet 551 guiding the water pumped from the upper water passage 334 to an upper surface of the upper piece 550. The upper water passage 334 is provided to enclose the upper recessed seat 333 and the output 551 is formed at an end of the upper water passage 334.

Once the motor 310 is actuated, the impeller 320 is rotated in a space defined by the lower and upper recessed seats 331 and 333. The water stored in the recess 110 of the sump housing 100 is introduced into the impeller 320 via the inlet 335 and the impeller 320 discharges the water in a radial direction. The water discharged from the impeller 320 moves along the water passage defined by the lower and upper water passages 337 and 334 and is finally led to the top surface of the upper piece 550 of the water guide assembly 500 via the outlet 551. A portion of the water having flown to the top surface of the upper piece 550 is selectively guided to the upper or lower arm 41 or 45 or is simultaneously guided to the upper and lower arms 41 and 45. The water guide assembly 500 is explained in detail as follows.

First of all, the water guide assembly 500 includes the upper and lower pieces 550 and 510. The upper piece 550 is provided with a valve receiving portion 553 communicating with the outlet 551. And, first and second guide passages 557 and 555 for supplying the water to the lower and upper arms 45 and 41 are connected to the valve receiving portion 553, respectively. In this case, the first guide passage 557 is provided to the top surface of the upper piece 550 from the valve receiving portion 553 to a center of the upper piece 550, while the second guide passage 555 is provided to the top surface of the upper piece 550 from the valve receiving portion 553 to an edge of the upper piece 550.

A diverting valve 810 is situated at the valve receiving portion 553 to guide a portion of the water flowing from the outlet 551 to the first or second guide passages 557 or 555 selectively or to the first and second guide passages 557 and 555 simultaneously. The diverting valve 810 basically communicates with the outlet 551 all the time and has a rib 811 enabling the first or second guide passage 557 or 555 to be selectively blocked. The diverting valve 810, as shown in FIG. 2, is loaded in the sump housing 100 and becomes situated at the valve receiving portion 553 when the water guide assembly 500 is mounted on the sump housing 100. For this, a hole 517 is formed at the lower piece 510 to correspond to the valve receiving portion 553 so that the diverting valve 810 and to be penetrated by the hole 517. A driving mechanism for actuating the diverting valve 810 is provided under the sump housing 100. The driving mechanism, as shown in FIG. 2, includes a step motor that can accurately control a rotational angle of the diverting valve 810.

Hence, when the dishwasher washes or rinses the dishes, the diverting valve 810 is reversibly rotated by the driving mechanism. In doing so, the rib 811 selectively blocks the first or second guide passage 557 or 555. Moreover, as the rotational angle of the diverting valve 810 is appropriately controlled so that the rib 811 may not block both of the first and second guide passages 557 and 555 to make them communicate with the outlet 551 simultaneously. Thus, the water pumped by the water supply pump 300 is supplied to the first or second guide passages 557 or 555 selectively or to the first and second guide passages 557 and 555 simultaneously. And, the water led to the first and second guide passages 557 and 555 is supplied to the upper and lower arms 45 and 41, respectively.

Meanwhile, the garbage or contaminant separated from the dishes comes into flowing in the sump assembly 50 together with the water, which may result in blocking the passages within the sump assembly 50. In the present invention, the sump assembly 50 is configured to filter the water pumped by the water supply pump 300 in part. Thereafter, the filtered water is stored again in the sump housing 100, i.e., the recess 110, to be supplied to the sprayers, i.e., the upper and lower arms 41 and 45. The filtering function and its associated configuration of the sump assembly 50 are explained in detail as follows.

First of all, a bypass 556 communicating with the outlet 551 is provided to the top surface of the upper piece 550. The bypass 556, as shown in the drawing, always communicates with the outlet 551, whereas the first and second guide passages 557 and 555 selectively communicate with the outlet 551 by the diverting valve 810. A sensor receiving portion 559 is provided in the middle of the bypass 556. A sensor assembly 700 is situated in the sensor receiving portion 559 to measure a degree of pollution of the water that flows in the bypass 556 by being pumped by the water supply pump 300.

The sensor assembly 700, as shown in FIG. 2, is loaded in the sump housing 100 to be situated at the sensor receiving portion 559 when the water guide assembly 500 is mounted on the sump housing 100. For this, a hole 519 is provided to the lower piece 510 to correspond to the sensor receiving portion 559 and to be penetrated by the sensor assembly 700.

A channel 710 communicating with the bypass 556, as shown in FIG. 2, is provided to traverse a center of the sensor assembly 700. Hence, the water introduced into the bypass 556 passes through the channel 710. A light emitting unit (not shown in the drawing) and a light receiving unit (not shown in the drawing) are provided within the sensor assembly 700 to oppose each other by leaving the channel 710 in-between. A light emitted from the light emitting unit is passed through the water flowing in the channel 710 to arrive at the light receiving unit. Hence, the sensor assembly 700 measures the degree of pollution of the water based on the intensity of the light received by the light receiving unit.

The water pollution degree measured by the sensor assembly 700 is used as a basis for determining a washing time, a washing number, a rinsing time, a rinsing number, and the like. For instance, if a quantity of light arriving at the light receiving unit is very weak, it means that the water is badly polluted. In such a case, the dishwasher changes the water or extends the washing or rinsing number by at least one time.

Meanwhile, the water having passed through the sensor assembly 700 arrives at a first drain 554 provided to an end of the bypass 556. The first drain 554 is connected to a second drain 513 provided to the lower piece 510, and extends to the drain chamber 900 of the sump housing 100 from the lower piece 510. Namely, the drain chamber 900 always communicates with the guide assembly, and more particularly, with the bypass 556. Hence, a portion of the water is passed through the bypass 556, the sensor assembly 700, and the first and second drains 554 and 513 to be introduced into the drain chamber 900.

Figure 3:
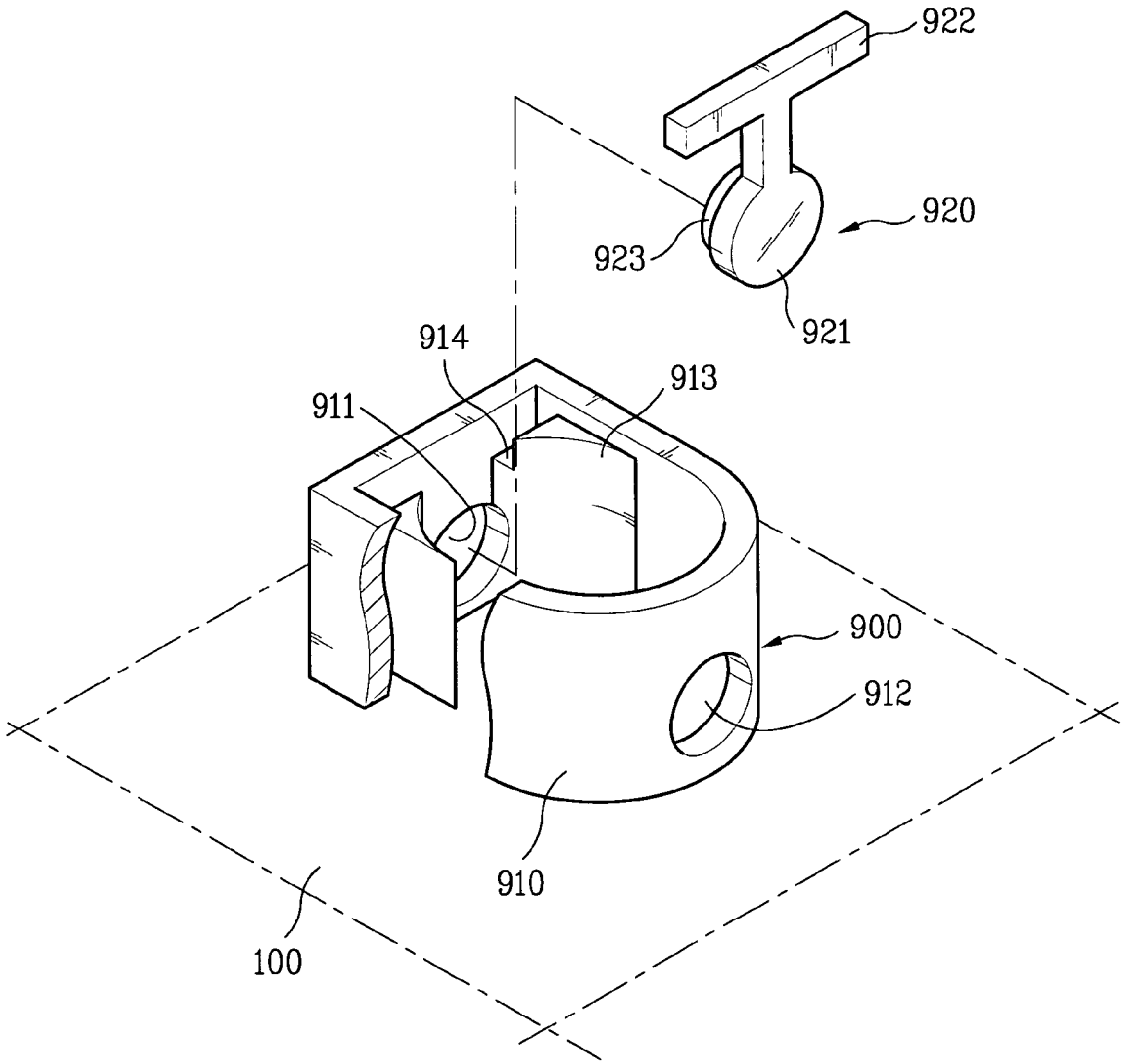
FIG. 3 is an exploded diagram of a drain chamber within a sump assembly according to the present invention.
Figure 4A:
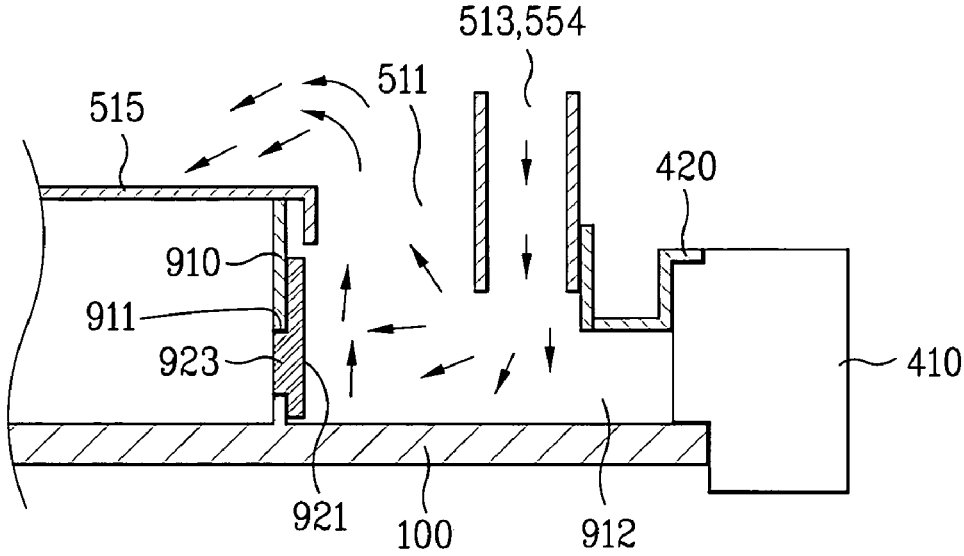
FIG. 4A is a cross-sectional diagram of a drain chamber operating in the process of washing.
Figure 4B:
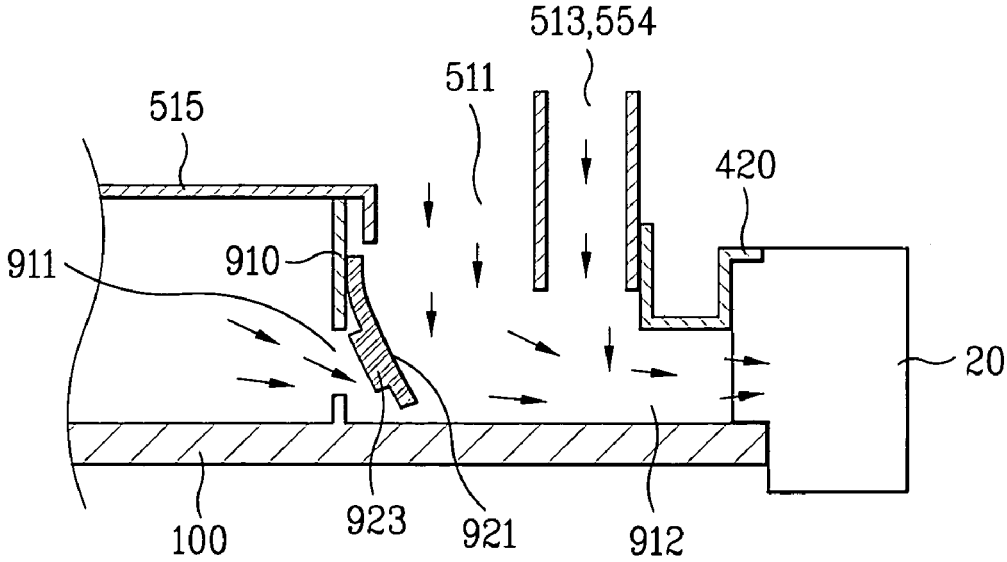
FIG. 4B is a cross-sectional diagram of a drain chamber operating in the process of draining.

The drain chamber 900, as explained in the foregoing description, is provided within the sump housing 100. The drain chamber 900, as shown in FIG. 3, includes a housing 910 forming a predetermined inner space. The housing 910 includes a first opening 911 communicating with the recess 110 and a second opening 912 communicating with the drain pump 400. And, the housing 910 further includes an open top to communicate with the guide assembly 500 via the open top. Specifically, the first to third drains 554, 513, and 511, as shown in FIG. 2, FIG. 4A, and FIG. 4B, are connected to a top portion of the housing 910 to enable the communication between the guide assembly 500 and the drain chamber 900. The first and second drains 554 and 513 guide the water within the guide assembly 500 to the drain chamber 900, and the third drain 511 guides the water within the drain chamber 900 to the guide assembly 500. To support the first to third drains 554, 513, and 511, a rib 913 is provided in the housing 910. In the present invention, the drain chamber 900 is configured to preliminarily filter the garbage or contaminant from the water while the dishes are washed. And, the drain chamber 900 serves as a path for draining the water in discharging the used water from the dishwasher. To effectively achieve the functions, the drain chamber 900 includes a valve 920 configured to allow the drain chamber 900 communicating with the guide assembly 500 to selectively communicate with the sump housing 100, and more particularly, with the recess 110.

The valve 920 substantially opens or closes the first opening 911 communicating with the recess 100 selectively. Specifically, the valve 920 includes a valve body 921 opening/closing the first opening 911 and a fixing portion 922 fixing the valve body 921 to the housing 910. Preferably, the valve body 921 has a protrusion 923 tightly fitted in the first opening 911 to enable a stable opening/closing of the first opening 911. The fixing portion 922, as shown in FIG. 3, is fitted in a recess 914 provided to the rib 913 to be stably supported therein. The valve 920 is actuated by the pressure of the water flowing within the drain chamber 900 to play a role as a check valve allowing a unidirectional flow of the water. Namely, the valve 920 opens the first opening 911 by the pressure of the water only if the water starts flowing to the drain chamber 900 from the recess 110, whereby the drain chamber 900 and the recess 110 come into communicating with each other. The valve 920 may be formed of an elastic material. In such a case, the valve 920 is elastically transformed by the pressure of the water to open the first opening 911. And, the fixing portion 922 can be configured with a hinge. In such a case, the valve 920 revolves centering on the fixing portion 922 to open the first opening 911.

Referring to FIG. 4B, the drain pump 400 is working while the water is drained, whereby the water within the recess 110 starts flowing to the drain chamber 900. The valve 920 opens the first opening 911 by the pressure of the flowing water to allow the drain chamber 900 to communicate with the sump housing 100, i.e., the recess 110. Hence, the drain chamber 900 communicates with the recess 110 as well as the guide assembly 500 while the water is discharged outside the dishwasher. Consequently, the drain pump 400 can discharge the water within the sump assembly, i.e., the guide assembly 500 and the recess 110, from the dishwasher via the drain chamber 900.

Alternatively, referring to FIG. 4A, while the dishes are washed, the water keeps being drained into the drain chamber 900 via the first and second drains 554 and 513 from the guide assembly 500. By the pressure of the drained water, the valve 920 closes the first opening 911. The valve 920 isolates the drain chamber 900 from the sump housing 100, i.e., the recess 110, whereby the drain chamber 900 communicates with the guide assembly 500 only via the first to third drains 554, 513, and 511 while the dishes are washed. Hence, the independent passage makes the water return to the guide assembly 900 via the drain chamber 900. Namely, the water is not discharged from the dishwasher via the drain hose 80 and is not introduced into the recess 110 as well.

Moreover, the drain chamber 900 is situated below the guide assembly 500. Hence, the water downwardly flows toward the drain chamber 900 from the guide assembly 500 via the first and second drains 554 and 513. Thereafter, the water upwardly flows toward the guide assembly from the drain chamber 900. For theses reasons, the garbage or contaminant involved in the water is deposited on a bottom of the drain chamber 900 due to its specific weight while the water passes through the drain chamber 900. Specifically, the garbage or contaminant having a relatively heavy weight, i.e., high specific weight, is deposited on the bottom of the drain chamber 900. Consequently, the drain chamber 900 plays a role in primarily filtering the garbage or contaminant from the washer while the dishes are washed.

Hence, the water drained from the drain chamber 900 ascends along the third drain 511 to return to the soil chamber 515, as shown in FIG. 2, within the guide assembly 500. As mentioned in the above explanation, the heavy garbage or contaminant included in the water is deposited on the bottom of the drain chamber 900 due to its weight but the light garbage and water are introduced into the soil chamber 515 only. The soil chamber 515, as shown in FIG. 2, is provided to the lower piece 510 to enclose the impeller housing of the water supply pump 300. The soil chamber 515 receives to store the water passed through the bypass 556 and the drain chamber 900 after the water has been pumped by the water supply pump 300. If the water keeps flowing in the soil chamber 515, a water level of the soil chamber 515 rises and the water finally floods out of the soil chamber 515.

Meanwhile, the cover 600 covers the water guide assembly 500 and the sump housing 100. For instance, the cover 600 has a disc shape. A multitude of openings are provided to its central part. And, a mesh type filter 610, as shown in FIG. 2, is provided to each of the openings. In this case, the openings and the filters 610 are arranged over the soil chamber 515. Hence, the water flooding from the soil chamber 515 passes through the filters 610 to be filtered and the contaminant or garbage failing to pass through the filter 610 remains in the soil chamber 515. Thus, the drain chamber 900 primarily filters the heavy garbage or contaminant from the water, whereas the soil chamber 515 secondarily filters the relatively light garbage or contaminant from the water. Hence, the water can be almost completely purified by filtering the garbage or contaminant while the dishes are washed. Even if the water is repeatedly used, the washing efficiency reduction or the blocking of the passage of the sump assembly is prevented. Moreover, due to the drain chamber 900, the soil chamber 515 just filters a small quantity of the garbage or contaminant that is relatively light, whereby the blocking or transformation of the filters 610 can be prevented.

A multitude of apertures 620 are provided to an edge area of the cover 600. The apertures 620 guide the falling water used in washing the dishes in the tub 20 of the dishwasher and the flooding water passed through the filter 610 from the soil chamber 515 to the sump housing 100. The water guided to the sump housing 100 is stored in the recess 110 at the center of the sump housing 100 together.

A first nipple 640 at a center of the cover 600 and a second nipple 630 at an edge of the cover 600, as shown in FIG. 2, are provided to a top surface of the cover 600. The first nipple 640 communicates with the first guide passage 557 of the water guide assembly 500 and the second nipple communicates with the second guide passages 555 of the water guide assembly 500. The second connecting pipe 65 connected to the lower arm 45 is connected to the first nipple 640, and the first connecting pipe 61 connected to the upper arm 41 is connected to the second nipple 630. Hence, the water introduced into the first guide passage 557 is supplied to the lower arm 45 via the first nipple 640 and the second connecting pipe 65. And, the water introduced into the second guide passage 555 is supplied to the lower arm 45 via the second nipple 630 and the first connecting pipe 61.

An operation of the above-configured sump assembly 50 according to the present invention is explained as follows.

First of all, once the dishwasher initiates a cycle or process of washing or rinsing dishes, clean water is introduced into the recess 110 of the sump housing 100 via the water supply hole 120 connected to the water supply pipe 70. The water introduced into the recess 110 is then heated by the heater 210, if necessary. If a corresponding water supply is completed, the motor 310 of the water supply pump 300 is driven so that the water stored in the recess 110 can be pumped by the impeller 320 to enter the guide assembly 500.

A portion of the pumped water flows in the valve receiving portion 553 via the outlet 551 and is then led to the first or second guide passage 557 or 555 by the diverting valve 810. The water led to the first guide passage 557 is supplied to the lower arm 45, while the other water led to the second guide passage 555 is supplied to the upper arm 41. The water supplied to the lower arm 45 washes the dishes put on the lower rack 35 and the water supplied the upper arm 41 washes the dishes put on the upper rack 31. Besides, the diverting valve 810 can connect both of the first and second guide passages 557 and 555 to the outlet 551 simultaneously. In such a case, the dishes on the upper and lower racks 31 and 35 can be washed by the water sprayed from the upper and lower arms 41 and 45, respectively.

The water used in washing the dishes in the tub 20 and the garbage or soil detached from the dishes fall down to the bottom of the tub 20. The falling garbage and water are re-introduced into the sump housing 100 via the apertures 620 provided to a circumference of the cover 600 to be re-stored in the recess 110. As mentioned in the foregoing description, the water fed back to the sump housing 110 contains a considerable quantity of contaminant or garbage. The garbage is finely grinded by the disposer 150 situated between the impeller 320 and the bottom of the recess 110 of the sump housing 100. And, the finely grinded garbage is pumped by the pump 300 to enter the guide assembly 500 together with the water.

Meanwhile, the rest of the water pumped by the impeller 320 of the pump is always introduced into the bypass 556. The water introduced into the bypass 556 passes through the channel 710 of the sensor assembly 700 that accurately measures the pollution degree of the water flowing in the channel 710. Hence, the dishwasher automatically adjusts the washing time, the washing number, the rinsing time, the rinsing number, etc. based on the pollution degree of the water sensed by the sensor assembly 700.

The water having passed through the sensor assembly 700 is introduced into the drain chamber 900 via the first and second drains 554 and 513. In doing so, since the drain pump 400 is not working, the water in the drain chamber 900 is not discharged from the drain chamber 900 but is directly introduced into the soil chamber 515 via the third drain 511. In ding so, heavy garbage included in the water introduced into the drain chamber 900 is deposited at the bottom of the drain chamber 900 due to its weight but the light garbage ascends along the third drain 511 to be introduced into the soil chamber 515.

The garbage and water introduced into the soil chamber 515 are stored therein. As time passes, the water level of the soil chamber 515 rises and the water finally floods out of the soil chamber 515. The flooding water is passed through the filter 610 and the apertures 620 of the sump housing 100 in turn to be re-introduced into the sump housing 100. Yet, the garbage introduced into the soil chamber 515 fails to pass through the filter 610 to be accumulated within the soil chamber 515.

As mentioned in the foregoing description, a prescribed quantity of the pumped water is passed through the bypass 556 to be purified by the filter 610 step by step and is then re-supplied to the sump housing 100. In doing so, it may seem that the soil chamber 515 and the filters 610 filter a small quantity of the water only. Yet, since they keep filtering the water across the washing or rinsing cycle overall, excellent water-filtering performance is achieved.

Meanwhile, if the washing or rinsing cycle is completed or if the water is badly polluted, the drain pump 400 is actuated. If so, the water and garbage stored in the soil chamber 515, the drain chamber 900, and the recess 110 of the sump housing 100 are discharged from the dishwasher by the drain pump 400 via the drain hose 80.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A sump assembly of a dishwasher, comprising:

a sump housing storing water therein;

a pump coupled with the sump housing to pump the water;

a guide assembly provided within the sump housing to guide the pumped water to a sprayer, and a drain chamber configured to filter contaminant from the water drained from the guide assembly, wherein the drain chamber is connected to a drain pump for draining the water, while dishes are washed, the water circulates in the guide assembly, and while the water is drained, the sump housing and the guide assembly communicate with each other by the operation of the drain pump so as to drain the water from the sump housing and the guide assembly, wherein the water returns to the guide assembly via the drain chamber, and wherein the drain chamber is provided within the sump housing and situated below the guide assembly, wherein the guide assembly is configured to bypass a portion of the pumped water to the drain chamber, and wherein the guide assembly further comprises a soil chamber communicating with the drain chamber to additionally filter the contaminant from the water drained from the drain chamber.

2. The sump assembly of claim 1, wherein the drain chamber is configured to deposit the contaminant on a bottom of the drain chamber.

3. The sump assembly of claim 2, wherein the contaminant has a weight larger than that of the water.

4. The sump assembly of claim 1, wherein the drain chamber is configured to allow the water to flow downwardly to the drain chamber from the guide assembly.

5. The sump assembly of claim 1, wherein the drain chamber is configured to allow the waster to flow upwardly from the drain chamber to the guide assembly.

6. The sump assembly of claim 1, further comprising a valve configured to allow the drain chamber to communicate with the sump housing selectively.

7. The sump assembly of claim 6, wherein the valve allows the drain chamber to communicate with the sump housing while the water is drained from the dishwasher.

8. The sump assembly of claim 6, wherein the valve isolates the drain chamber from the sump housing while dishes are washed.

9. The sump assembly of claim 6, wherein the valve is provided to the drain chamber to open/close an opening communicating with the sump housing selectively.

10. The sump assembly of claim 6, wherein the valve is a check valve.

11. The sump assembly of claim 6, wherein the valve is operated by a pressure of the water flowing in the drain chamber.

12. The sump assembly of claim 6, the valve comprising:

a valve body opening/closing an opening provided to the drain chamber; and a fixing portion fixing the valve body to the drain chamber.

13. The sump assembly of claim 12, wherein the valve body comprises a protrusion tightly fitted in the opening.

14. The sump assembly of claim 6, wherein the valve is flexed to allow the drain chamber to communicate with the sump housing.

15. The sump assembly of claim 6, wherein the valve is formed of an elastic material.

16. The sump assembly of claim 6, wherein the valve is rotated to allow the drain chamber to communicate with the sump housing.

17. The sump assembly of claim 1, further comprising a cover covering the sump housing and the guide assembly.

18. The sump assembly of claim 17, wherein the cover comprises at least one aperture guiding the water sprayed on dishes to the sump housing.

19. A dishwasher comprising:

a housing;

a tub provided within the housing to receive tableware therein;

a sprayer provided within the tub to spray water on the tableware; and a sump assembly, comprising:

a sump housing storing the water therein;

a pump coupled with the sump housing to pump the water;

a guide assembly provided within the sump housing to guide the pumped water to a sprayer; and a drain chamber configured to filter contaminant from the water drained from the guide assembly, wherein the drain chamber is connected to a drain pump for draining the water, while dishes are washed, the water circulates in the guide assembly, and while the water is drained, the sump housing and the guide assembly communicate with each other by the operation of the drain pump so as to drain the water from the sump housing and the guide assembly, wherein the water returns to the guide assembly via the drain chamber, and wherein the drain chamber is provided within the sump housing and situated below the guide assembly, wherein the guide assembly is configured to bypass a portion of the pumped water to the drain chamber, and wherein the guide assembly further comprises a soil chamber communicating with the drain chamber to additionally filter the contaminant from the water drained from the drain chamber.

20. The dishwasher of claim 19, wherein the drain chamber is configured to deposit the contaminant on a bottom of the drain chamber.

21. The dishwasher of claim 20, wherein the contaminant has a weight larger than that of the water.

22. The dishwater of claim 19, wherein the drain chamber is configured to allow the water to flow downwardly to the drain chamber from the guide assembly.

23. The dishwasher of claim 19, wherein the drain chamber is configured to allow the water to flow downwardly to the drain chamber from the guide assembly.

24. The dishwasher of claim 19, further comprising a valve configured to allow the drain chamber to communicate with the sump housing selectively.

25. The dishwasher of claim 24, wherein the valve allows the drain chamber to communicate with the sump housing while the water is drained from the dishwasher.

26. The dishwasher of claim 24, wherein the valve isolates the drain chamber from the sump housing while the tableware is washed.

27. The dishwasher of claim 24, wherein the valve is provided to the drain chamber to open/close an opening communicating with the sump housing selectively.

28. The dishwasher of claim 24, wherein the valve is a check valve.

29. The dishwasher of claim 24, wherein the valve is operated by a pressure of the water flowing in the drain chamber.

30. The dishwasher of claim 24, the valve comprising:

a valve body opening/closing an opening provided to the drain chamber, and a fixing portion fixing the valve body to the drain chamber.

31. The dishwasher of claim 30, wherein the valve body comprises a protrusion tightly fitted in the opening.

32. The dishwasher of claim 24, wherein the valve is flexed to allow the drain chamber to communicate with the sump housing.

33. The dishwasher of claim 24, wherein the valve is formed of an elastic material.

34. The dishwasher of claim 24, wherein the valve is rotated to allow the drain chamber to communicate with the sump housing.

35. The dishwasher of claim 19, further comprising a cover covering the sump housing and the guide assembly.

36. The dishwasher of claim 35, wherein the cover comprises at least one aperture guiding the water sprayed on the tableware to the sump housing.

* * * * *